United States Patent [19]

Larsen

[11] Patent Number: 4,643,320

[45] Date of Patent: Feb. 17, 1987

[54] CRANE BRACKET FOR MOUNTING OVER THE CHASSIS SIDE MEMBERS OF A TRUCK

[75] Inventor: Gunnar M. Larsen, Vaerloese, Denmark

[73] Assignee: Hiab Export A/S, Humlebaek, Denmark

[21] Appl. No.: 678,718

[22] Filed: Dec. 6, 1984

[30] Foreign Application Priority Data

Dec. 16, 1983 [DK] Denmark ..... 5812/83

[51] Int. Cl.[4] ..... B66C 23/44

[52] U.S. Cl. ..... 212/180; 212/182; 212/189; 212/254; 414/680

[58] Field of Search ..... 212/175–181, 212/182, 189, 254, 265; 414/680, 686, 920

[56] References Cited

U.S. PATENT DOCUMENTS

| | | | |
|---|---|---|---|
| 2,487,305 | 11/1949 | Bridegroom | 212/189 |
| 2,670,086 | 2/1954 | Eisberg | 212/254 |
| 3,023,914 | 3/1962 | McGuire et al. | 212/189 |
| 3,734,319 | 5/1973 | Frisk | 414/686 |
| 4,069,922 | 1/1978 | Hawkins | 212/181 |
| 4,463,858 | 8/1984 | Bilas | 212/176 |

*Primary Examiner*—Galen Barefoot
*Assistant Examiner*—Stephen P. Avila
*Attorney, Agent, or Firm*—Felfe & Lynch

[57] ABSTRACT

A bracket for mounting a crane over either chassis side member of a truck has an elongated body member having removable, telescopically-extendable rods at its ends provided with likewise-telescopic supporting legs to provide support against the driving surface. A platform protrudes transversely from the body member for releasable acceptance of the crane. The body member and platform are symmetrical about a center plane longitudinal of the body member for permitting the use of the bracket for right-hand and left-hand mounting of the crane by turning the bracket upside down, particularly when the platform is closer to one end of the body member than the other.

8 Claims, 3 Drawing Figures

CRANE BRACKET FOR MOUNTING OVER THE CHASSIS SIDE MEMBERS OF A TRUCK

Figure 1:
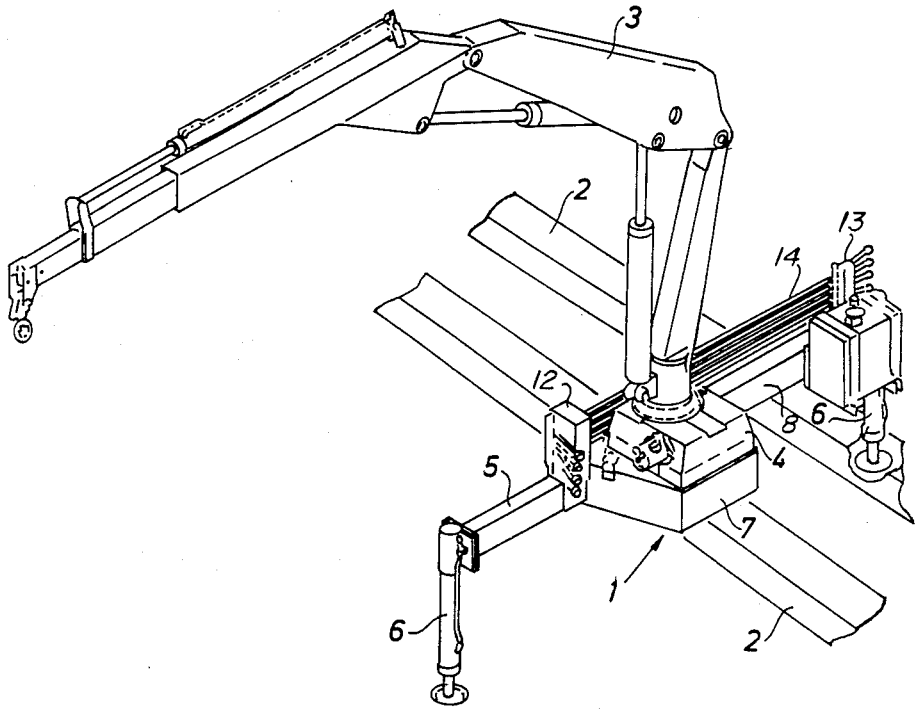

The invention relates to a bracket for mounting a crane on a vehicle and, more particularly, over chassis side members of a truck.

A known bracket for mounting a crane on a truck has a body member with a length essentially corresponding to the width of the loading body (cargo platform) of the truck and a platform protruding from the body member to support the column of the crane. Such crane brackets have long been used for securing so-called truck cranes either to the loading body of the truck or between the loading body and the cab of the truck. Generally, telescopic rods are also provided of the bracket for sliding into and out of the body member of the bracket with likewise-telescopic supporting legs at their free ends. The supporting legs are placed against the driving surface (ground) when the crane is to be used for transmitting a large portion of the weight of a load on the crane through the supporting legs to relieve the loading body and the chassis of the truck as much as possible.

It is advantageous that the crane column is closer to the cab of the truck than the supporting legs so that the supporting legs are under the area swept by the crane in normal operation, such area being an arc-shaped area ranging from the crane column over the loading body and away from the cab. If the crane column was placed farther away from the cab than the supporting legs or at the same distance as these, load situations would occur in which the forces deriving from the load on the crane could only be transferred to the driving surface through the truck chassis and/or loading body, thereby defeating the supporting legs.

The aforesaid conditions mainly determine the placement and design of the crane bracket. The ordinary practice has therefore been to integrate the crane column base into the bracket so that the bearings around which the crane column rotates are placed in a bearing housing integral with the platform protruding from the body member of the bracket or welded to it.

It has been found, however, that there is a need for mounting the crane column on the left or right behind the cab, in part because the truck may be left-hand or right-hand driven and in part because certain users prefer to have the crane column placed behind the driver's seat, i.e. adjacent the passing traffic, whereas other users prefer the crane to be placed on the truck away from passing traffic.

In the past, these requirements have been met with a bracket for left-side mounting and a bracket for right-side mounting. It goes without saying that this results in less flexibility and greater stocks, etc.

The object of the invention is, therefore, to provide a bracket for mounting a crane on either the right-hand or left-hand side of a vehicle, and which can, at the same time, be used for cranes of varying sizes and capacities.

According to the invention, this object is achieved by a bracket having an elongated body member for mounting the bracket on a vehicle and a crane-supporting platform protruding transversely therefrom. The bracket is symmetrical about a longitudinal center plane and the platform is designed for releasable acceptance of a crane on either side.

By designing the bracket symmetrically around a longitudinal center plane and having the platform closer to one end and for releasable acceptance of the crane base on either side, merely turning the bracket upside down provides for mounting the crane on the right-hand or left-hand side of the vehicle. By doing away with the prejudice that the crane base must be an integral part of a bracket for a crane having a certain capacity, separating the crane base and platform and using anchoring devices therebetween in an additional mounting step, the same bracket can be used for several cranes within a specific crane series in which individual cranes may be constructed identically in principle, but provided with several and differently dimensioned links.

Figure 2:
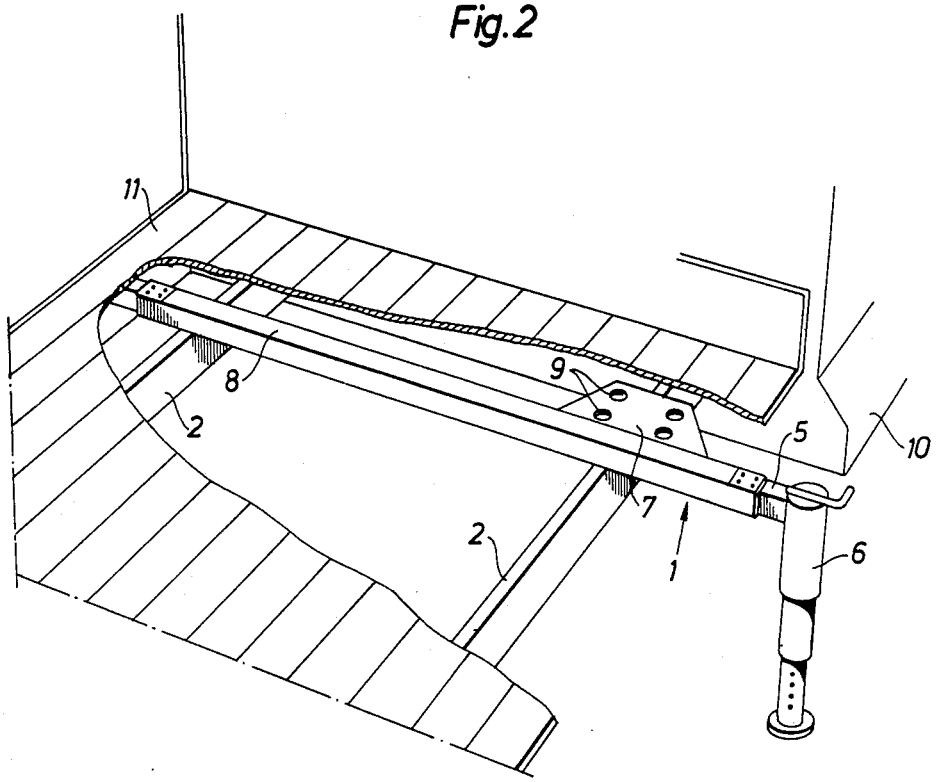
Figure 3:
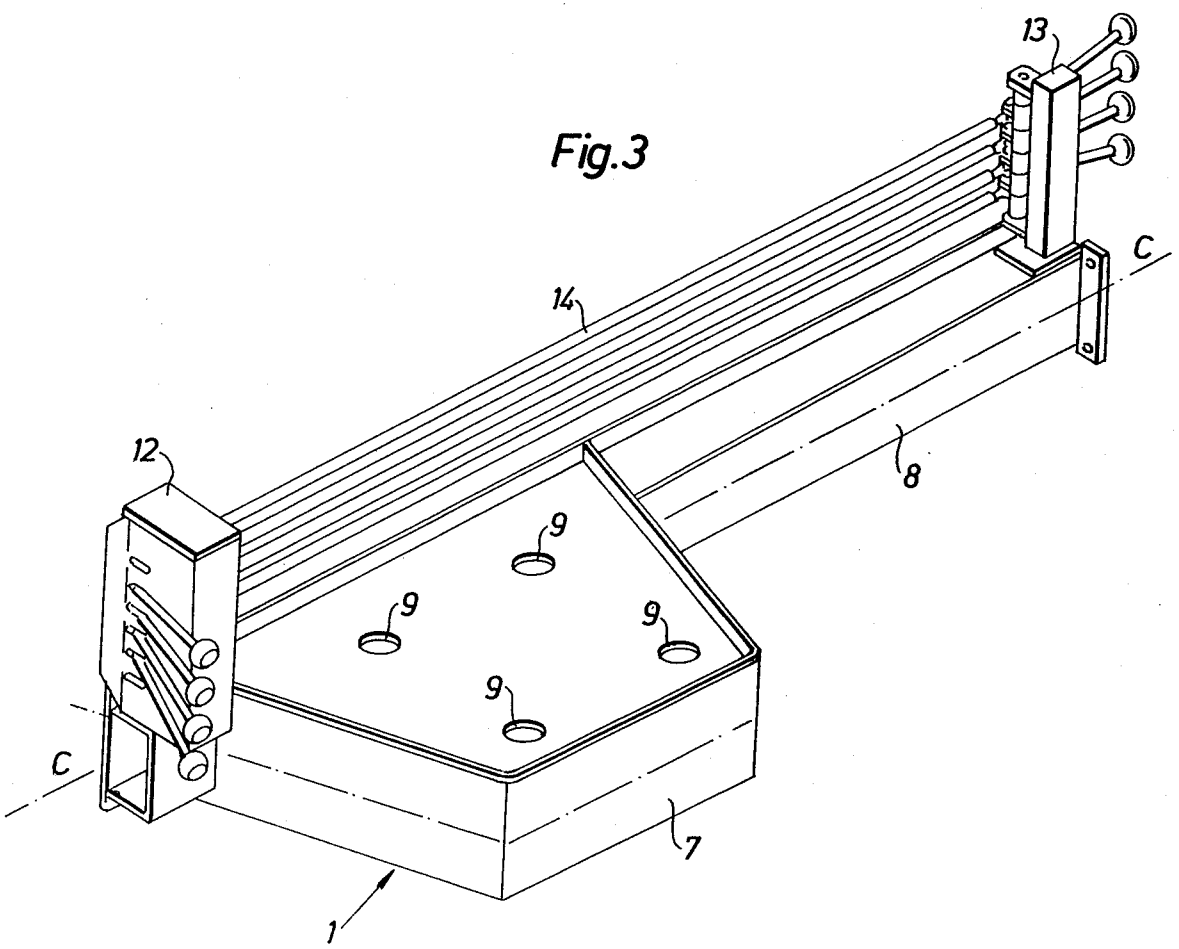

The invention will now be described in more detail below, with reference to drawings in which:

FIG. 1 perspectively shows a bracket according to the invention with attached supporting legs, operating panels and connecting rods, and a crane;

FIG. 2 perspectively shows the bracket of FIG. 1 with only the supporting legs; and FIG. 3 is an enlarged, perspective view of the bracket of FIG. 1 with only the operating panels and connecting rods not shown in FIG. 2.

The truck crane 3 shown in FIG. 1 is provided with a crane base 4 designed for releasable mounting on a platform 7 of an elongated bracket 1. The bracket 1, which is provided with telescopic rods 5 at its ends for extending the bracket beyond the loading body (11 in FIG. 2) of a truck in the working position, is placed above schematically-shown chassis side members 2 of a conventional truck. In the working position, the telescopic rods 5 are drawn out of the bracket 1 like the one shown on the left and likewise-telescopic supporting legs 6 are placed against the driving surface.

In FIG. 2, the placement of the bracket 1 on the truck is shown in more detail. Behind a cab 10, the truck has a loading body 11 which is conventionally placed on the chassis side members 2 which run parallel to the longitudinal direction of the vehicle. Above the chassis side members 2, an elongated body member 8 of the bracket 1 is placed and secured by anchoring devices (not shown, but known per se) to the side members 2. A platform 7 protrudes transversely from the body member 8 closer to one of its ends for positioning the crane on one side of the truck or, as later described, the other side. It is provided with through-going holes 9 which can be lined with suitable bushings (not shown) for accepting bolts (not shown) cooperating with tapped holes or nuts in the crane base 4 for mounting the crane 3 on the platform 7. Instead of the shown through-going holes, longitudinal slots may be provided in the platform, thus facilitating mounting, as aligning the crane base accurately in relation to the holes 9 is no longer required. As indicated on the drawing, the bracket 1 may be mounted under the loading body 11, but it will often be preferable to mount the bracket in a space between the cab 10 and the loading body 11.

FIG. 3 is an enlarged view of the bracket, illustrating how operating panels 12, 13 may be mounted above the body member 8, such panels containing hydraulic control valves for operating the crane. In the shown embodiment, the two operating panels 12 and 13 are mechanically interconnected by means of rods 14, such that the crane can be optionally operated from either side of the truck's loading body. In the shown embodiment, the body member 8 is formed by a hollow profile, and the platform 7 which is made of welded sheeting is secured to the body member, e.g. by welding.

As best shown in FIG. 3, the elongated body member 8 and transversely-projecting platform 7 of the bracket 1 is symmetrical about a longitudinal center plane C—C. That is, the top and bottom of the bracket correspond.

As best shown in FIG. 2, the bracket is shown oriented for right-side mounting of the crane. If, however, it is desired to mount the crane on the left, this can be done by turning the bracket upside down around a center line transverse to the elongated body member 8. That is, the bracket is turned 180° around a line parallel to the side members 2 and in the center between these.

What is claimed is:

1. A bracket for mounting a crane on a vehicle, comprising: an elongated body member (8) for mounting the bracket on the vehicle, and a platform (7) protruding transversely from the body member (8) for supporting the crane, the body member (8) and platform (7) being symmetrical about a center plane (C—C), longitudinal of the body member (8), whereby the platform (7) is designed for releasable acceptance of the crane on either side, and the platform (7) being closer to one end of the body member (8) than the other, whereby the bracket is adapted for mounting the crane on opposite sides of the vehicle by turning the bracket upside down.

2. The bracket of claim 1, and further comprising means (9) in the platform for mounting the crane thereon.

3. The bracket of claim 1, and further comprising removable telescopic rods (5) having supporting legs (6) on the ends of the body member (8).

4. The bracket of claim 2, and further comprising removable telescopic rods (5) having supporting legs (6) on the ends of the body member (8).

5. The bracket of claim 1, in combination with the crane, and further comprising a base on the crane for supporting the crane on the platform.

6. The bracket of claim 2, in combination with the crane, and further comprising a base on the crane for supporting the crane on the platform.

7. The bracket of claim 3, in combination with the crane, and further comprising a base on the crane for supporting the crane on the platform.

8. The bracket of claim 4, in combination with the crane, and further comprising a base on the crane for supporting the crane on the platform.

* * * * *